US008001957B2

(12) United States Patent
Clauss et al.

(10) Patent No.: US 8,001,957 B2
(45) Date of Patent: Aug. 23, 2011

(54) DEVICE FOR INCREASING POWER FOR A LIMITED TIME

(75) Inventors: Stéphane Clauss, Lipsheim (FR); Martin Oberhomburg, Wetter (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 95 days.

(21) Appl. No.: 11/990,539

(22) PCT Filed: Aug. 2, 2006

(86) PCT No.: PCT/EP2006/064934

§ 371 (c)(1),
(2), (4) Date: Feb. 15, 2008

(87) PCT Pub. No.: WO2007/020189

PCT Pub. Date: Feb. 22, 2007

(65) Prior Publication Data

US 2008/0216810 A1 Sep. 11, 2008

(30) Foreign Application Priority Data

Aug. 16, 2005 (EP) ..... 05017744

(51) Int. Cl.
*F24C 3/12* (2006.01)
*F23N 1/00* (2006.01)

(52) U.S. Cl. ..... 126/42; 126/36 R; 126/39 E; 431/284; 431/6; 431/12

(58) Field of Classification Search ..... 126/42, 126/26 R, 39 E; 431/284, 6, 12
See application file for complete search history.

(56) References Cited

U.S. PATENT DOCUMENTS

| | | | | |
|---|---|---|---|---|
| 4,381,718 | A * | 5/1983 | Carver et al. | 110/347 |
| 4,838,183 | A * | 6/1989 | Tsaveras et al. | 110/190 |
| 5,014,630 | A * | 5/1991 | Looker | 110/194 |
| 5,575,638 | A * | 11/1996 | Witham et al. | 431/73 |
| 6,318,357 | B1 * | 11/2001 | Muhle et al. | 126/39 R |
| 6,952,997 | B2 * | 10/2005 | Shimrony et al. | 110/345 |
| 2006/0016444 | A1 | 1/2006 | Clauss et al. | |

FOREIGN PATENT DOCUMENTS

| | | | |
|---|---|---|---|
| DE | 101 01 733 | | 7/2002 |
| DE | 10101733 | A1 * | 7/2002 |
| EP | 836054 | A1 * | 4/1996 |
| EP | 802374 | A1 * | 10/1997 |
| EP | 0 836 054 | | 4/1998 |

(Continued)

OTHER PUBLICATIONS

International Search Report PCT/EP2006/064934.

*Primary Examiner* — Steven B McAllister
*Assistant Examiner* — Nikhil Mashruwala
(74) *Attorney, Agent, or Firm* — James E. Howard; Andre Pallapies

(57) ABSTRACT

A gas cooking hob comprising at least one gas burner, a main pipe for supplying gas, a main nozzle on the gas burner, and a control device for adjusting the heating power of the gas burner between a minimum power and a nominal power. In order to further develop said gas cooking hob, a timing member is provided which allows the heating power to be increased beyond the nominal power during a certain interval.

18 Claims, 2 Drawing Sheets

FOREIGN PATENT DOCUMENTS

| | | | | |
|---|---|---|---|---|
| EP | 836054 | A1 | * | 4/1998 |
| EP | 1 172 607 | | | 1/2002 |
| EP | 1172607 | A1 | * | 1/2002 |
| FR | 2 532 719 | | | 3/1984 |
| GB | 2154813 | A | * | 2/1984 |
| GB | 2 231 397 | | | 11/1990 |
| JP | 61-38322 | | | 2/1986 |
| JP | 61038322 | A | * | 2/1986 |
| JP | 2-290426 | | | 11/1990 |

* cited by examiner

DEVICE FOR INCREASING POWER FOR A LIMITED TIME

The invention relates to a gas cooktop with at least one gas burner, a main pipe for supplying gas, a main nozzle on the gas burner and an operator control device influencing the main nozzle to adjust the heating power of the gas burner between a minimum power and a nominal power. The nominal power represents the highest power that can be permanently demanded. In general, the operator control device contains a valve that is arranged in the main gas pipe and provides at least one straight-through position and one closed position. As a rule, the straight-through position can be adjusted in steps or continuously between a minimum throughput and a nominal throughput.

A so-called booster function is known in electric cookers. Here, usually at the start of a cooking process, a particularly high power output is generated in order to reduce the waiting time before the simmering state is reached. The increased power output at the start of the cooking process is used for example to rapidly heat up the still cold cooking pot and the product being cooked that has likewise not yet reached the correct temperature. Other typical applications for this are the heating-up of a large quantity of water or the rapid searing of meat. On expiration of a time interval the power is automatically reduced to a level selected by the operator.

The object of the invention is therefore to provide a device that allows the gas cooktop to be operated for a limited time above the nominal power, that is to say in a so-called booster mode. In this case, the booster mode shall be possible not just at the start of a cooking process.

This object is achieved in a gas cooktop of the type stated in the introduction by a timer switching device that allows the heating power to be increased beyond the nominal power for the duration of a time interval. Consequently, a heating power that is increased by around 20 to 30% can be demanded for a period of 10 to 15 minutes, for example. In gas cooktops it is necessary to limit the time interval of the power overshoot because the nominal power of the gas cooktop is chosen so that it can also be demanded in the continuous operating mode without causing damage. Exceeding the nominal power could, for example, cause parts made from special steel in the area of the gas cooktop to be permanently discolored if heated up above a threshold temperature of around 200° C. In principle, the device for the booster mode can be arranged at any cooking point. For economic reasons however, it is recommended that only one gas burner, namely the heavier-duty or heaviest-duty one be fitted for the booster mode.

An increase in the heating power of the gas burner can be simply controlled via its gas supply. According to an advantageous embodiment of the invention, a shut-off device can be connected in the main pipe via the timer switching device, which shut-off device allows an additional gas flow to the gas burner, that is to say a gas flow that exceeds the maximum power. In a simplest embodiment, the shut-off device has either a straight-through or a closed position. In order to avoid the aforesaid damage due to maloperation, the shut-off device can be activated only via the timer switching device.

In order to increase the power of the gas burner, an increased gas flow is therefore supplied to it. This gas supply can be achieved in different ways. According to a first alternative, an auxiliary gas pipe that opens into an auxiliary nozzle in a gas burner, can be connected via the shut-off device. The increase in the heating power is effected by providing the gas flow with additional access to the gas burner. For its part, this construction offers two performance options:

According to a first embodiment, the auxiliary gas pipe can have a larger cross-section than the main pipe and be operated alternately to the main pipe for the duration of the time interval. The booster operation therefore takes place exclusively via its own pipe system with its own nozzle. This has the advantage that it can be precisely specified via the dimensioning of its own pipe system in order to eliminate damage due to unintentional power overshoot.

On the other hand, a special pipe for booster operation means greater technical outlay. According to a second embodiment, the auxiliary gas pipe can therefore be operated in addition to the main pipe for the duration of the time interval. The gas flow which reaches the gas burner in the booster mode is then determined by the passage through the main pipe and additionally by the passage through the auxiliary pipe. The auxiliary pipe of the second alternative can therefore be of smaller dimensions than those of the first embodiment, which reduces the technical outlay and the costs of the second embodiment. According to a second alternative, a main nozzle that provides the gas passage for the booster mode, and a restrictor connected upstream of it which defines the nominal power of the gas burner, can be arranged in a main line. The choice of restrictor depends, among other things, on the type of burner and on the different calorific values of various types of gases. It should therefore be easily interchangeable—like the main nozzle—or easily adjustable. In a simple case its adjustment can be ensured by means of a screw, for example. According to the invention, the auxiliary gas pipe now forms a bypass around a restrictor in the main pipe. The power of the gas burner in the booster mode is therefore obtained by routing the gas flow unimpeded around the restrictor and as a result the restrictor is made virtually inoperative. A further reduction in the technical outlay for the booster mode can thus be achieved because a second pipe and an auxiliary nozzle in the burner can be dispensed with. Here a further two construction possibilities present themselves. On the one hand, an additional path around the restrictor can be provided for the gas flow, so that the passage through the restrictor and that through the other gas pipe together produce the gas flow for the booster power. On the other hand, an alternate path around the restrictor can be provided for the gas flow, which alone makes the gas passage available for the booster power, whilst the restrictor is completely deactivated. Whereas in the first case a simple shut-off device suffices to open the other pipe just in the booster mode and close it for the rest of the time, for the second option a two-way valve is required to conduct the gas flow either through the restrictor for normal operation or through the other pipe for the booster mode. In both cases it is obvious to combine the restrictor and the shut-off device in a compact component in order to reduce the technical outlay and space requirement for this.

According to a further advantageous embodiment of the invention, the shut-off device can be designed as a solenoid valve. In this form it represents a simple technical construction since its function, however, is reliably fulfilled and can be controlled with low technical outlay via switching currents, for example.

In order to prevent damage to the gas cooktop, the booster mode should therefore be maintained only for a specific time interval. The timer switching device required therefor can be based on a mechanical or an electronic operating principle, or a combination of these. The length of the time interval to be controlled by said operating principle must in any case be set. This can be effected by the operator or in the factory. The latter is to be preferred since damage to the cooktop due to a time interval that is set excessively long cannot be ruled out in the case of operator intervention. According to a further advantageous embodiment of the invention, the gas cooktop can therefore have a control system with a timer switching device that activates the shut-off device for the duration of the preset time interval in accordance with an operator signal. A control system in which a timer switching function can be accommodated is usually provided anyway in modern gas cooktops. In the simplest form, the operator signal can be generated by a switch in the control panel of the gas cooktop. An optical and/or audible indicator can be provided as the check-back signal for the switch-on operation.

According to a further advantageous embodiment of the invention, the control system can additionally activate the shut-off device in accordance with signals generated by the appliance. Preferably, these signals refer to the temperature actually detected in the parts susceptible to damage. On the one hand they can be measured directly by temperature sensors. This is certainly the most precise data acquisition option, but does mean higher technical outlay and correspondingly high costs. On the other hand, the temperature can be determined indirectly via the time that the relevant gas burner is in operation. For example, the control system can therefore activate the booster mode according to whether the relevant gas burner is already in operation and so is already at the minimum operating temperature. If this is the case, then the control system can shorten the time interval for the booster mode in order to prevent the aforesaid heating-up of the gas burner from exceeding a critical temperature and thus causing damage.

By way of an example, the principle of the invention is explained in further detail below with the aid of a drawing. In the drawing.

Figure 1:
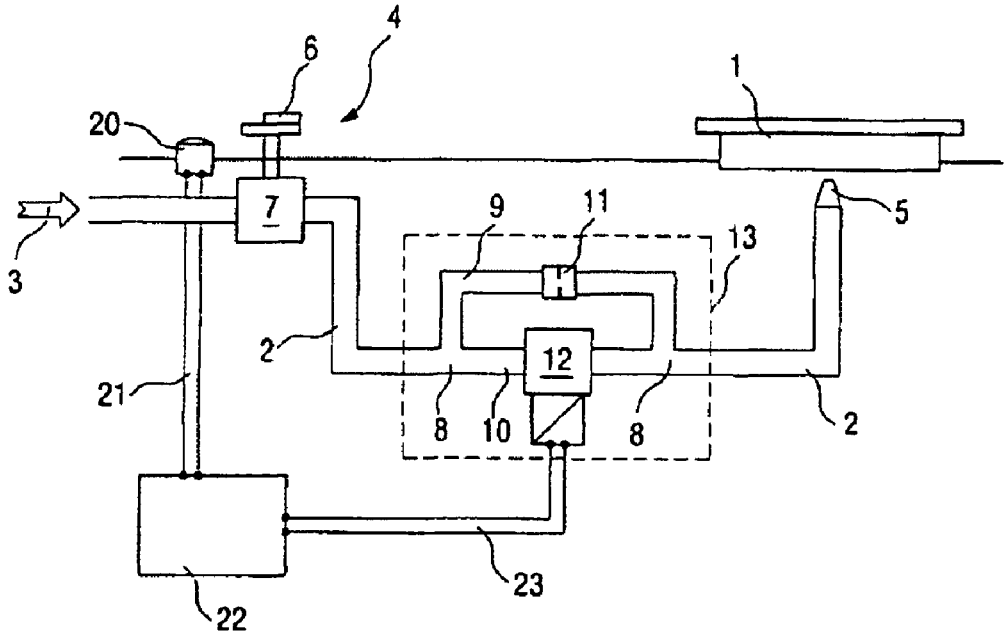
FIG. 1 shows a first embodiment of the invention with only one main nozzle on the gas burner.

FIG. 1 shows the schematic construction of a gas cooktop with a gas burner 1, which is supplied with combustible fuel via a main gas pipe 2. The main gas pipe 2 leads from a gas source 3, shown schematically by an arrow, via an operator control device 4 to a main nozzle 5 in the gas burner 1. The operator control device 4 includes a rotary knob or twist knob 6 that is used to manually switch a gas flow through the main gas pipe 2 on or off. It operates in conjunction with a gas tap 7 that is arranged in the main gas pipe 2 and sets the gas flow through the main gas pipe 2.

Two branches 8, between which two gas pipe sections 9 and 10 run in parallel, are arranged in the main gas pipe 2. A restrictor 11 having a diameter of 1.25 cm is arranged in the pipe section 9. A solenoid valve 12, with which the pipe section 10 can be opened or fully closed, is arranged in the pipe section 10 running in parallel. For reasons of space and maintenance, the branches 8, the restrictor 11 and the solenoid valve 12 can be combined in a compact component 13.

At its end, the main gas pipe 2 opens into the main nozzle 5, which has a diameter of 1.3 cm. The main nozzle 5 therefore has a greater diameter than that of the restrictor 11. The purpose of this is, via the restrictor 11, to limit the maximum or nominal power of the cooktop to a value at which the gas cooktop and, in particular, the gas burner 1 sustain no damage during continuous operation, for example due to overheating. This nominal power can be 2.8 KW, for example.

In addition to the twist knob 6 of the operator control device 4, a so-called booster switch 20 is arranged on a control panel, not shown in detail. Said booster switch is connected via an electrical cable connection 21 to a control unit 22. The control unit 22 is connected via an additional electrical cable connection 23 to the solenoid valve 12. The solenoid valve 12 can therefore be activated by means of the booster switch 20 only by the interposition of the control unit 22.

In normal operation the heating power of the gas burner 1 is controlled by means of the operator control device 4. This operator control device allows the power of the gas flow in the main pipe 2 to be set between zero throughput, or minimum power, just before extinction of the gas burner flame, and nominal power. In this case, the gas flow takes the path through the main gas pipe 2, the pipe section 9 and the restrictor 11 to the main nozzle 5. Even when nominal power at the gas burner 1 is chosen, the heating-up period of a cooking pot on the gas burner 1 can be undesirably long.

If the operator wishes to accelerate the initial heating-up process, then he can operate the booster switch 20. The switch 20 then passes a signal to the control unit 22 which thereupon opens the solenoid valve 12. This makes it possible for the gas flow to bypass the restrictor 11 via the pipe section 10. The unrestricted gas flow in the pipe section 10 thus reaches the main nozzle 5, which now has the smallest cross-section within the main pipe 2. With its larger diameter in relation to that of the restrictor 11, the main nozzle 5 provides a higher power at the gas burner 1, of 3.3 KW, for example. However, since during continuous operation this higher power could lead to damage due to overheating at the gas burner 1, for instance, the control unit 22 closes the solenoid valve 12 automatically and time-dependently according to a predetermined, factory-set time interval, for example. Consequently, maloperation on the part of the operator and resulting damage are virtually eliminated.

Figure 2:
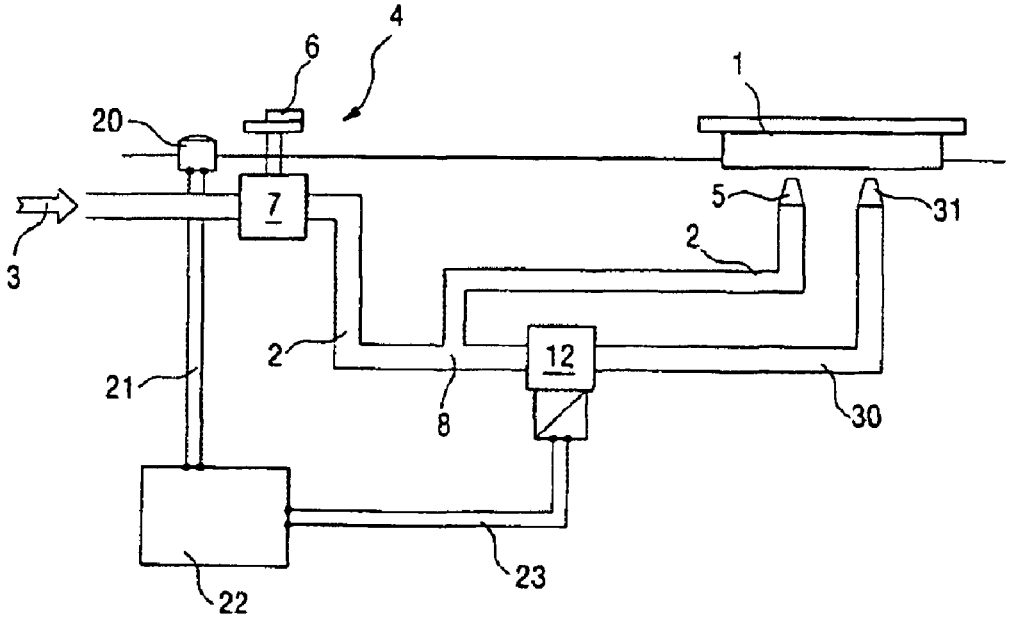
FIG. 2 shows a second embodiment of the invention with two nozzles per gas burner.

FIG. 2 shows an alternate arrangement. Here again a main gas pipe 2 runs from a gas source 3 to a main nozzle 5 inside a gas burner 1. The gas flow within the main pipe 2 can again be influenced by an operator control device 4. The main gas pipe 2 now has only one branch 8, off which an auxiliary pipe 30 branches and leads to an auxiliary nozzle 31. Like the main nozzle 5, the auxiliary nozzle 31 is arranged inside the gas burner 1. Again, the gas flow within the auxiliary pipe 30 can be turned on or off by a solenoid valve 12. As in the preceding exemplary embodiment, said solenoid valve is activated via a booster switch 20 that acts via cable connections 21 on a control unit 22, which routes a switching control signal to the solenoid valve 12 via the cable connection 23.

In normal operation, the gas flow takes the path from the gas source 3 along the main gas pipe 2, past the operator control device 4 to the main nozzle 5. The gas burner 1 is supplied with combustible fuel via this path during a normal cooking process. Here, in contrast to the exemplary embodiment described above, the nominal power of the gas burner 1 is determined by the diameter of the main nozzle 5. When the booster switch 20 is operated the solenoid valve 12 opens the auxiliary pipe 30. The gas flow can then reach the gas burner 1 via the auxiliary pipe 30 and the following auxiliary nozzle 31 as well as via the main pipe 2. This gives rise to an additional gas flow which increases the power of the gas burner 1. The open position of the solenoid valve 12 is also time-limited in this embodiment. At the expiration of a preset time interval that is also stored in the control unit, the control unit 22 automatically closes the solenoid valve 12 in order to turn off the additional gas flow through the auxiliary pipe 30.

Figure 3:
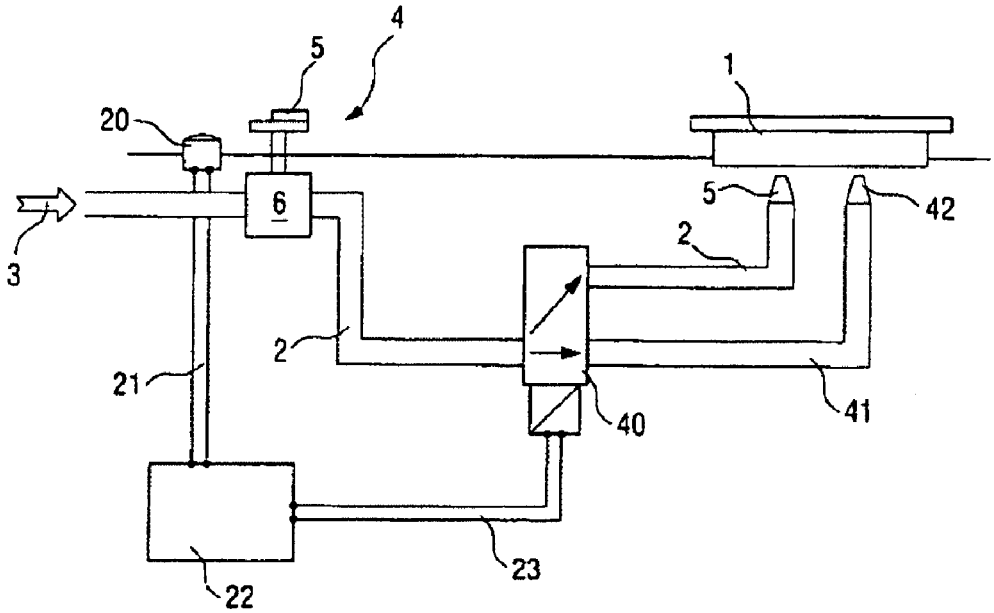
FIG. 3 shows a third embodiment, likewise with two nozzles per gas burner.
Figure 4:
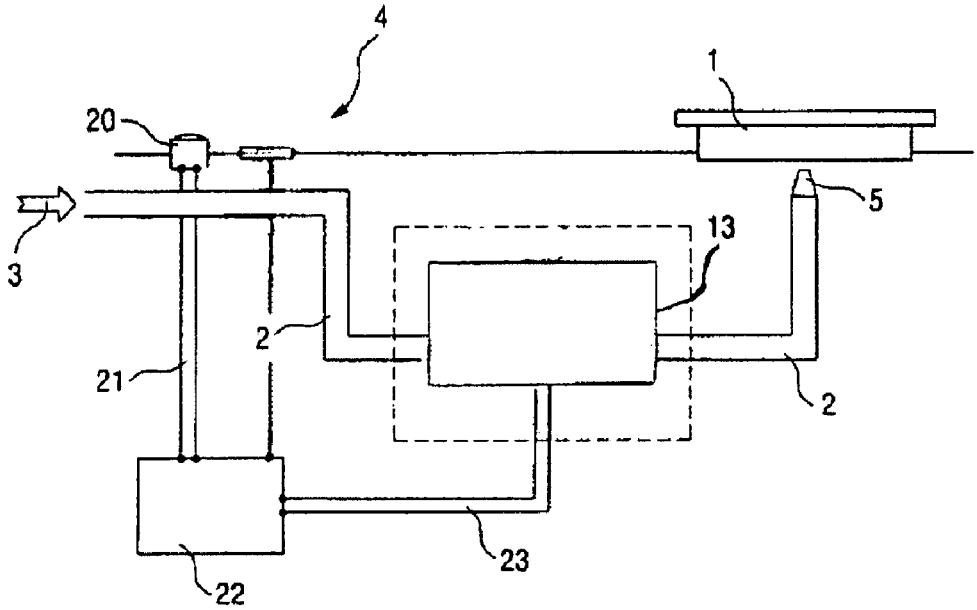
FIG. 4 shows a fourth embodiment in which a shut-off device is designed as a valve block with a number of control pipes, which are not shown.

FIG. 3 shows a further alternative to the two above-mentioned exemplary embodiments. Here too, identical components are given the reference numbers that are already known. Again, a main gas pipe 2 connects a gas source 3 to a main nozzle 5 in a gas burner 1. Due to its diameter, the main nozzle 5 defines the nominal power of the gas cooktop. The gas flow within the main gas pipe 2 can likewise be controlled by an operator control device 4. As described above, the booster switch 20 is connected via a cable connection 21 to a control unit 22. Via a cable 23, and differing from the previous embodiments, the control unit 22 now switches a two-way valve 40 which either opens the path through the main gas pipe 2 to the main nozzle 5 or as an alternative to this, cuts off the main nozzle 5 from the gas source 3 and instead routes the gas flow through an auxiliary pipe 41 to an auxiliary nozzle 42 in the gas burner 1. The auxiliary nozzle 42 has a larger diameter than that of the main nozzle 5.

In contrast to the previously described exemplary embodiments, gas is admitted to the valve 40, even in the normal operation of the gas burner 1 of FIG. 3. Actually, it allows the gas flow to pass freely through the main pipe 2 to the main nozzle 5. Operation of the booster switch 20 now has the effect of isolating the main nozzle 5 from the gas supply and a greater gas flow is routed through the auxiliary pipe 41 in the booster mode. Again, the diameter of the main nozzle 5 therefore determines the normal or nominal power of the gas burner 1. On the other hand, the higher booster power is now defined exclusively by the auxiliary nozzle 42. In the manner already explained, said booster power is maintained by the control unit for only a limited time and is switched off at the expiration of a predetermined time interval.

Since the preceding arrangements that have been described in detail involve exemplary embodiments, they can be modified to a great extent by the expert in the usual manner without departing from the scope of the invention. Furthermore, the use of the indefinite article "a" does not preclude the relevant features from also existing in the plural.

LIST OF REFERENCE NUMBERS

1 Gas burner
2 Gas pipe
3 Gas source
4 Operator control device
5 Main nozzle
6 Twist knob
7 Gas tap
8 Branch
9 Pipe section
10 Pipe section
11 Restrictor
12 Solenoid valve
13 Compact component
20 Booster switch
21 Electric cable
22 Control unit
23 Electric cable
30 Auxiliary pipe
31 Auxiliary nozzle
40 Two-way valve
41 Auxiliary pipe
42 Auxiliary nozzle

The invention claimed is:

1. A gas cooktop having a main pipe for receiving supply gas, said gas cooktop comprising at least one gas burner having a main nozzle operatively associated therewith, an operator control device operatively associated with the main nozzle for controlling the main nozzle in a manner to adjust the heating power of the gas burner only between a minimum power and a nominal power, and a timer switching device for increasing the heating power beyond nominal power for the duration of a predetermined time interval while the operator control device remains set between said minimum power and said nominal power, said predetermined time interval being controlled by the timer switching device, wherein the predetermined time interval must be set prior to or upon increasing the heating power beyond said nominal power, and wherein, after the predetermined time interval has expired, the heating power of the gas burner returns to between said minimum power and said nominal power set by the operation control device.

2. The gas cooktop according to claim 1 and further comprising a shut-off device for providing additional gas flow to the gas burner, with the shut-off device being controlled by the timer switching device.

3. The gas cooktop according to claim 2 and further comprising an auxiliary nozzle in the gas burner and an auxiliary gas pipe in fluid communication with the auxiliary nozzle wherein the auxiliary gas pipe is controlled by the shut-off device.

4. The gas cooktop according to claim 3, wherein the auxiliary gas pipe is formed with a cross-sectional dimension greater than the cross-sectional dimension of the main pipe, with the auxiliary gas pipe being configured to deliver gas to the gas burner for the duration of the predetermined time interval with the auxiliary pipe operating as a substitute for the main pipe.

5. The gas cooktop according to claim 3, wherein the auxiliary gas pipe is configured for operation in addition to the main pipe for the duration of the time interval.

6. The gas cooktop according to claim 3, wherein the main pipe is formed with a restrictor element therein and the auxiliary gas pipe is configured to form a bypass around the restrictor in the main pipe.

7. The gas cooktop according to claim 6, wherein the shut-off device and the restrictor are arranged as a compact component.

8. The gas cooktop according to claim 2 wherein the shut-off device includes a solenoid valve.

9. The gas cooktop according to claim 2 and further comprising a control unit, including said timer switching device, in operational communication with the shut-off device for actuating the shut-off device for the duration of the predetermined time interval in accordance with an operator signal.

10. The gas cooktop according to claim 9 wherein the control unit actuates the shut-off device in accordance with one of a detected temperature and an operating time of the gas burner.

11. The gas cooktop according to claim 10 wherein a switch is provided for actuating the timer switching device.

12. The gas cooktop according to claim 2 wherein the shut-off device is formed as a valve block having a plurality of control pipes with the plurality of control pipes being formed with a plurality of different cross-sectional dimensions.

13. The gas cooktop according to claim 12 wherein the control pipes of the valve block are set to one of an opened condition and a closed condition using the operator control device.

14. The gas cooktop according to claim 12 wherein all control pipes of the valve block are opened using the timer switching device.

15. The gas cooktop according to claim 1, wherein the timer switching device is selectively operable based on user input such that in an increased heating mode, the timer switching device and the operator control device work in conjunction, and, in a normal heating mode, only the operator control device is operable to supply said power to the burner and the timer switching device is not activated.

16. The gas cooktop according to claim 1, wherein the timer switching device is independently operable relative to the operator control device when the operator control device is set to supply heating power to the gas burner.

17. The gas cooktop according to claim 1, wherein the timer switching device may be operated at any time during which the operator control device is activated.

18. The gas cooktop according to claim 1, wherein, during the predetermined time interval when the heating power increases beyond said nominal power, temperature of the gas burner is caused to increase.

* * * * *